US010371331B1

(12) United States Patent
Kosta

(10) Patent No.: US 10,371,331 B1
(45) Date of Patent: Aug. 6, 2019

(54) FRAMELESS DECORATIVE LED NIGHT LIGHT

(71) Applicant: Marie Spollen Kosta, Austin, TX (US)

(72) Inventor: Marie Spollen Kosta, Austin, TX (US)

( * ) Notice: Subject to any disclaimer, the term of this patent is extended or adjusted under 35 U.S.C. 154(b) by 0 days.

(21) Appl. No.: 15/976,835

(22) Filed: May 10, 2018

Related U.S. Application Data

(60) Provisional application No. 62/505,795, filed on May 12, 2017.

(51) Int. Cl.

| | |
|---|---|
| ***F21S 8/00*** | (2006.01) |
| ***F21Y 115/10*** | (2016.01) |
| ***F21W 121/00*** | (2006.01) |
| ***F21V 17/12*** | (2006.01) |
| ***F21K 9/232*** | (2016.01) |
| ***F21V 19/00*** | (2006.01) |

(52) U.S. Cl.
CPC ..... *F21S 8/035* (2013.01); *F21K 9/232* (2016.08); *F21V 17/12* (2013.01); *F21V 19/0055* (2013.01); *F21W 2121/00* (2013.01); *F21Y 2115/10* (2016.08)

(58) Field of Classification Search
CPC ..... F21S 8/033; F21S 8/035; H01R 13/717; F21V 1/146; F21V 1/14; F21K 9/232; F21W 2121/00; F21Y 2115/10
See application file for complete search history.

(56) References Cited

U.S. PATENT DOCUMENTS

| | | | | | |
|---|---|---|---|---|---|
| 2,075,364 | A * | 3/1937 | Smith | F21S 8/035 | 362/397 |
| 2,239,340 | A * | 4/1941 | Davi | F21S 6/002 | 362/307 |
| 3,735,118 | A * | 5/1973 | Martin | F21S 8/035 | 362/124 |
| 4,714,984 | A * | 12/1987 | Spector | F21S 8/035 | 362/101 |
| 4,878,162 | A * | 10/1989 | Wu | F21S 8/035 | 362/352 |
| 5,622,424 | A * | 4/1997 | Brady | F21S 8/035 | 362/644 |
| 5,662,408 | A * | 9/1997 | Marischen | F21S 8/035 | 362/253 |
| 8,342,732 | B2 * | 1/2013 | Chien | F21S 8/035 | 362/249.02 |
| 10,184,630 | B1 * | 1/2019 | Wang | F21S 13/02 | |
| 2005/0185402 | A1 * | 8/2005 | Hsu | F21S 8/035 | 362/257 |
| 2005/0226006 | A1 * | 10/2005 | Chen | F21S 8/035 | 362/641 |

(Continued)

*Primary Examiner* — Mariceli Santiago

(57) ABSTRACT

A night light design for providing a decorative image on a frameless design that allows solves prior inoperability of night lights that don't have easy access to the night light fixture and bulb and therefore become inoperable when the bulb and/or night light fixture ceases to work. This night light allows for more emitted light than a traditional night light due to the light being able to shine through the front as well as all four sides (left, right, top, bottom). Night light omits the left, right, top and bottom sides that are included in many night lights, helping save on the material cost without loss of capability. The direct-print printing process allows the customer to choose any design of their choice with no limitations which allows for limitless designs.

7 Claims, 3 Drawing Sheets

(56) References Cited

U.S. PATENT DOCUMENTS

| | | | | |
|---|---|---|---|---|
| 2007/0076437 | A1* | 4/2007 | Chien | F21S 8/035<br>362/641 |
| 2016/0053951 | A1* | 2/2016 | Wang | F21S 8/035<br>362/644 |
| 2017/0328370 | A1* | 11/2017 | Bloom | F21V 23/04 |

* cited by examiner

FRAMELESS DECORATIVE LED NIGHT LIGHT

CROSS REFERENCE TO RELATED APPLICATION

This application claims the benefit of provisional patent application No. U.S. 62/505,795 filed May 12, 2017 by the present inventor.

FEDERALLY SPONSORED RESEARCH

None

SEQUENCE LISTING

None

BACKGROUND

Prior Art

The following is a tabulation of some prior art that presently appears relevant:

| Pat. No. | U.S. Patent Issue Date | Patentee |
|---|---|---|
| 4,912,609A | Mar. 27, 1990 | Kenneth R Gillette |
| 5,622,424 | Apr. 22, 1997 | Floyd Brady |
| 9,360,179B2 | Feb. 14, 2014 | Mary Elle Fashions |
| 8,545,090 | Oct. 1, 2013 | Tseng-Lu Chien |
| 7,832,918 | Dec. 30, 2008 | Tseng-Lu Chien |

This relates to night lights, specifically to a frameless night light with a decorative front cover that contains a night light fixture and LED bulb. This night light solves prior inoperability of night lights due to the frameless design of the night light that allows for easy access and replacement of the bulb and/or night light fixture without loss of operability. The addition of a plastic bracket at the bottom of the back cover allows for the night light fixture to be removed and replaced with ease. This frameless night light reduces material cost and manufacturing costs by omitting the left, right, top and bottom sides that are included in many night lights as a way to enclose the night light. Many traditional night lights don't have access to the night light fixture or bulb so that when the light goes out, the whole night light has to be discarded. In addition, this night light solves the problem of decorative night lights not providing enough light by using a frameless design that allows the light to shine through not only the front cover but also out all four sides of the night light (left, right, top, bottom). The 4-color direct-print printing process using UV inks allows the customer to choose any design of their choice with no limitations which can produce unlimited design options.

In conclusion, insofar as I am aware, no night light formerly developed provides a frameless design with a decorative front cover that is printed directly onto the front cover that allows easy access to the night light fixture and LED bulb. The addition of a plastic bracket at the bottom of the back cover allows for the night light fixture to be removed and replaced with ease as opposed to many nightlights that have the night light fixture adhered permanently to the night light base. This solves prior inoperability of many night lights that have the night light fixture adhered permanently to part of the night light structure which causes these other night lights to become inoperable when a bulb or fixture fails. This frameless night light omits the left, right, top and bottom sides that are included in many night lights, which helps save on the material cost and manufacturing cost without loss of operability and makes the manufacturing process easier. This night light also provides more light than traditional night lights due to the frameless design that allows light to emanate through the front decorative cover as well as all four sides of the night light (left, right, top, bottom). The fact that the decorative image is printed directly onto the front cover provides consistency with the light shining evenly throughout the front cover as opposed to some night lights where the light is concentrated in a certain portion of the cover and is not evenly dispersed. The direct-print printing process allows the customer to choose any design of their choice with no limitations which provides versatility and limitless options for designs. This direct-print printing process solves the inoperability of night lights that use a sticker affixed to the front or a picture that is inserted into the fixture. These stickers and inserts over time will peel, bend, and fade.

SUMMARY

This improved night light has a frameless design with a front and back cover made of 1/16" thick translucent white acrylic material adhered by 2" nylon screws 1/4" diameter that provides more light than traditional night lights due to the fact that the bright LED bulb shines not only through the decorative front of the night light but also from all 4 openings (left side, right side, top, bottom). The addition of a plastic bracket at the bottom of the back cover allows for the night light fixture to be removed and replaced with ease as opposed to many nightlights that have the night light fixture adhered permanently to the night light base. With traditional decorative night lights, if the night light fixture and/or bulb ceases to work, the whole night light needs to be thrown out because there is no access to the night light fixture or bulb to change them out and in many cases the night light fixture is affixed permanently to the night light frame. This factor solves prior inoperability of night lights that don't have easy access to the night light fixture and bulb and therefore become inoperable when the bulb and/or night light fixture ceases to work. This frameless night light omits the left, right, top and bottom sides that are included in many night lights to enclose the structure, which helps save on the material and manufacturing cost without loss of operability thus making the manufacturing process easier and cheaper. In addition, the image on the front of the night light is printed directly onto the cover while many traditional night lights either use a sticker or a system that allows for an image to be inserted into the night light cover. The fact that the image is printed directly onto the cover allows for the LED light to shine evenly through the front cover and light up the whole cover, not just the middle or certain sections of the night light. The direct-print printing process allows the customer to choose any design of their choice with no limitations, providing limitless options for designs. The LED bulb is an improvement over traditional bulbs because it is cool to the touch so it will not burn anyone who touches the bulb. The LED bulb is also extremely cost effective while producing as much light as a traditional bulb that gets hot and uses more electricity than an LED bulb.

Advantages

The Frameless Decorative LED Night Light has many advantages over prior night lights. These advantages include:

1: Ease of access to night light fixture and bulb. The addition of a plastic bracket at the bottom of the back cover allows for the night light fixture to be removed and replaced with ease as opposed to many nightlights that have the night light fixture adhered permanently to the night light base.

2: The frameless night light omits the left, right, top and bottom section that is used in many night lights to enclose the night light. This saves on material costs and manufacturing costs while providing easy access to the night light fixture and bulb.

3: Frameless design that provides more light than traditional night because light emanates not only through the front decorative cover but also from all four sides (top, bottom, left, right)

4: The direct-print printing process allows customer to choose any image without limitation, allowing for an infinite number of designs.

5: The direct-print printing method is an improvement on other night lights whose decorative image is adhered to the night light cover either via a sticker that will peel off over time or a design that allows a decorative image to be inserted into the front cover, which will bend and fade over time.

DRAWINGS

Figure 3:
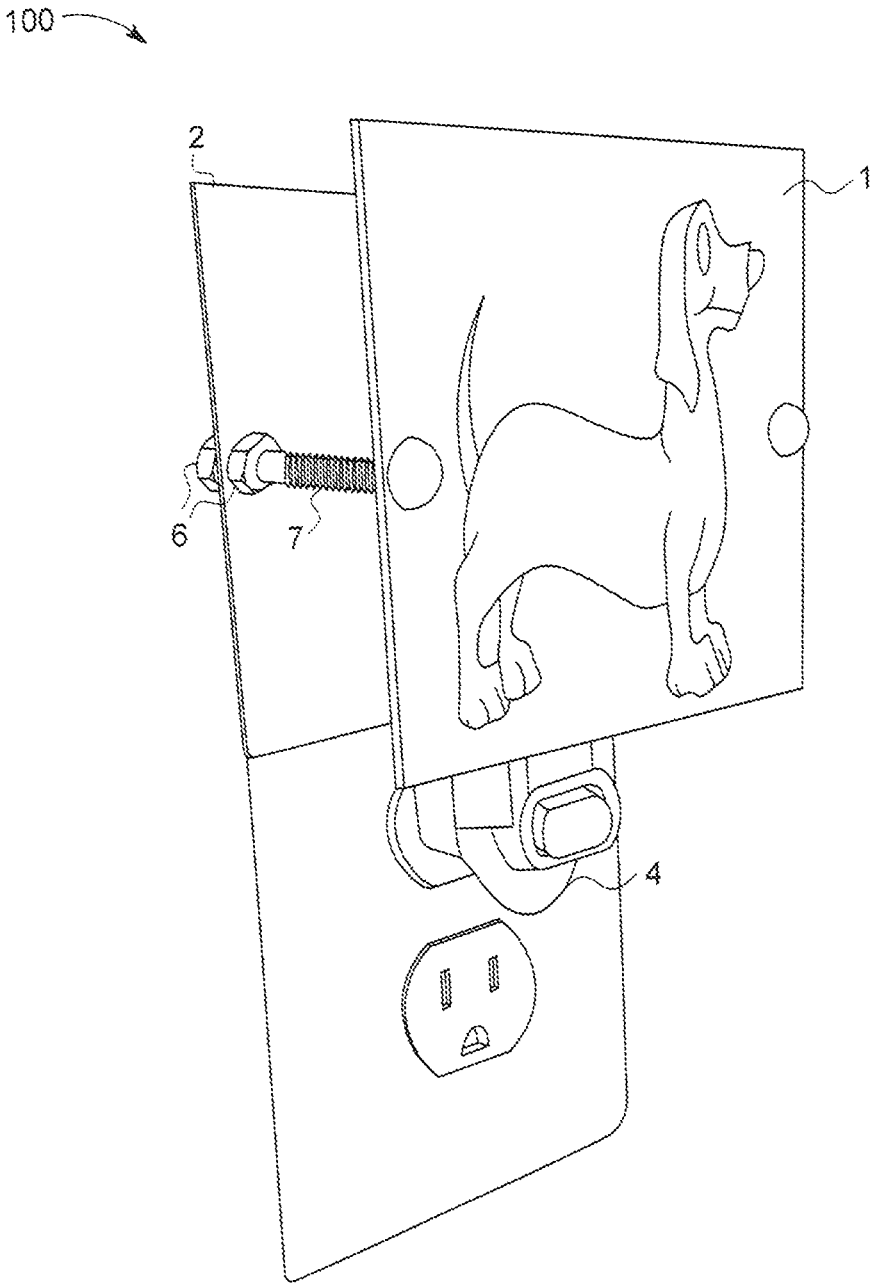

FIG. 3 is a perspective view from the front showing a left-side view of a night light constructed in accordance with the invention, showing the night light from the user's left side view. Note that the image printed on the night light cover is an example of one of the designs. The direct-print printing process allows the customer to choose any design of their choice with no limitations.

REFERENCE NUMERALS

1 Front Cover
2 Back Cover
3 Night Light clip-on shade mounting bracket
4 Night Light Fixture UL Listed 2-prong plug polarized on left
5 LED Night Light Bulb
6 Nylon Hex nut ¼" diameter
7 Nylon Slotted Screw 2" long, ¼" diameter

DETAILED DESCRIPTION

Figure 1:
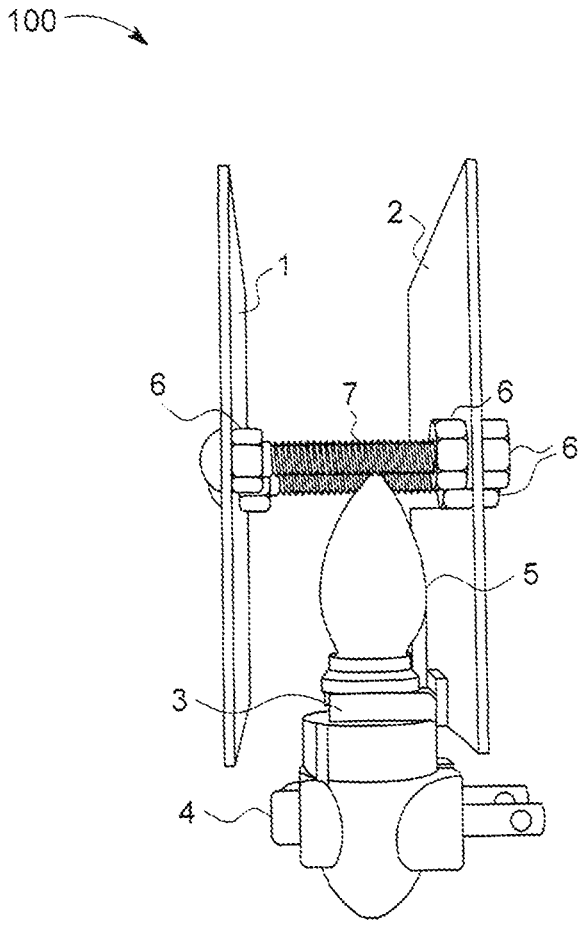
FIG. 1 is a perspective right-side view of a night light constructed in accordance with the invention, showing the night light from the user's right side view.
Figure 2:
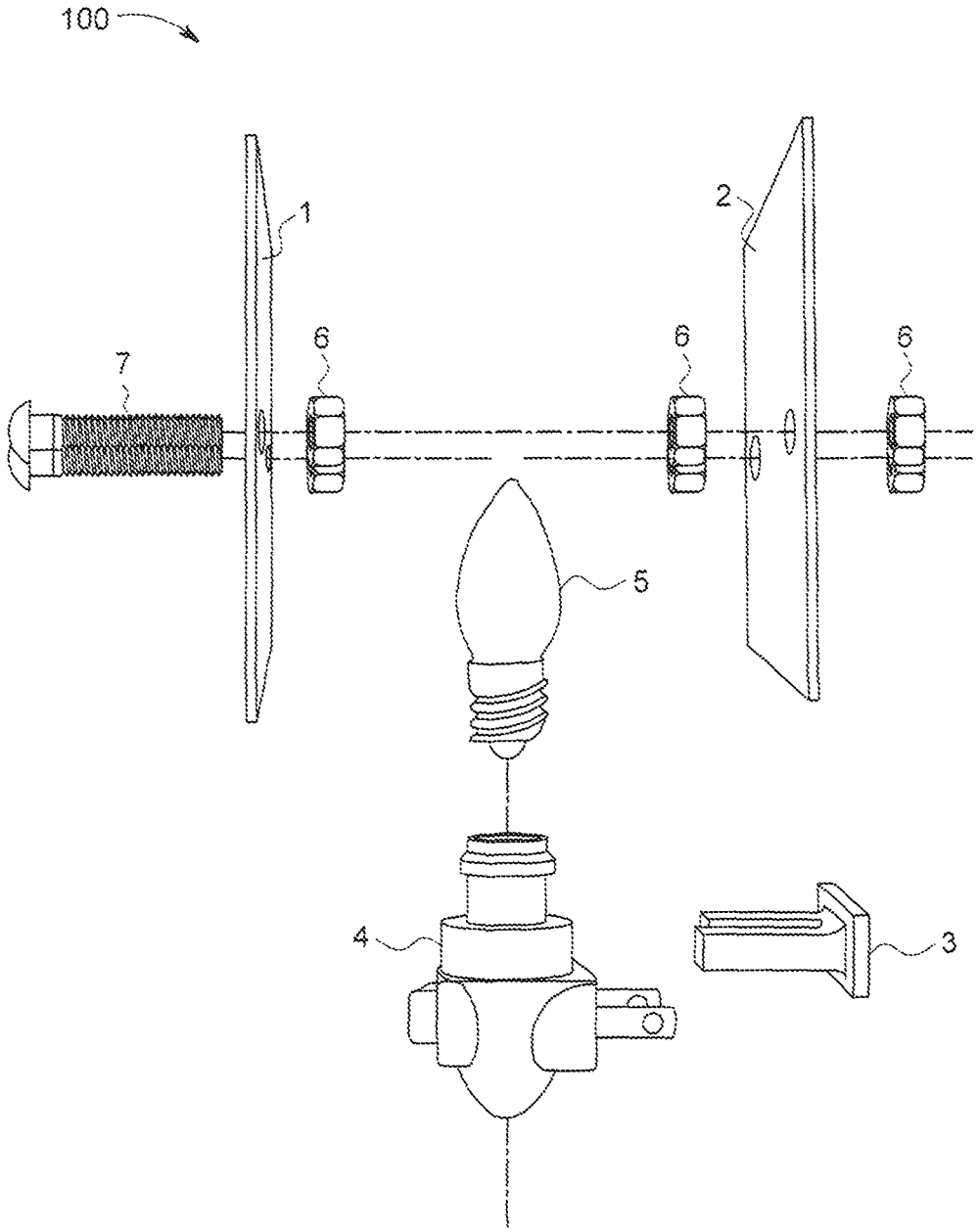
FIG. 2 is an exploded view showing the construction of a night light constructed in accordance with the invention, showing the night light from the user's right side view.

FIG. 1 is a perspective view taken from the user's right side of a night light constructed in accordance with the invention. Part 1 is the front cover of the night light and is made of 1/16" thick Translucent white acrylic with a decorative image printed directly onto the cover. Dimensions are 4" square (length and height). There is a ¼" diameter hole on both the right and left sides of Part 1, 2" up from the bottom and ¼" in from the left and right side of the cover. Part 2 is the back cover of the night light and is made of 1/16" thick translucent white acrylic. Dimensions are 4" square (length and height). There is a ¼" diameter hole on both the right and left sides of Part 2 back cover, 2" up from the bottom and ¼" in from the left and right side of the cover. Part 3 is the Night Light clip-on shade mounting bracket and is attached with industrial strength adhesive to Part 2 back cover on the inside of Part 2 at the bottom centered between the right and left side. Part 4 is a standard night light fixture UL Listed and is clipped into Part 3. Part 5 is an LED night light bulb, ceramic style C7 bulb, E12 socket and is screwed into Part 4. Part 6 is a Nylon finished Hex nut ¼" diameter. Part 7 is a Nylon Machine Screw 2" Length, slotted, ¼" diameter. Two Part 7 screws are threaded through Part 1 cover, one each on the left and right sides. Two Part 6 nuts are screwed onto Part 7 screw, one each on the left and right side, all the way up the screw so that Part 7 screw is surrounded on one side by Part 1 cover and the other side by Part 6 nut. Two Part 6 nuts are threaded onto Part 7 screw, one each on left and right side so that there is ¼" of Part 7 screw between nut and end of screw. Part 2 back cover is placed on top of Part 7 screw with Part 3 night light clip-on shade mounting bracket on inside of Part 2 back cover. Part 3, 4 and 5 are facing inward and are between Part 1 front cover and Part 2 back cover. Two Part 6 nuts are threaded onto each Part 7 screw, one each on left and right side so that Part 2 back cover sits between two sets of Part 6 nuts. FIG. 2 is an exploded view showing the construction of a night light constructed in accordance with the invention, showing the night light from the user's right side view. Part 1 is the front cover of the night light and is made of 1/16" thick translucent white acrylic with a decorative image printed directly onto the cover. The direct-print printing process allows the customer to choose any design of their choice with no limitations. Dimensions are 4" square (length and height). There is a ¼" diameter hole on both the right and left sides of Part 1, 2" up from the bottom and ¼" in from the left and right side of the cover. Part 2 is the back cover of the night light and is made of 1/16" thick translucent white acrylic. Dimensions are 4" square (length and height). There is a ¼" diameter hole on both the right and left sides of Part 2 back cover, 2" up from the bottom and ¼" in from the left and right side of the cover. Part 3 is the Night Light clip-on shade mounting bracket and is attached with industrial strength adhesive to Part 2 back cover on the inside of Part 2 back cover at the bottom centered between the right and left side. Part 4 is a standard night light fixture UL Listed and is clipped into Part 3 night Light clip-on shade mounting bracket. Part 5 is an LED night light bulb, ceramic style C7 bulb, E12 socket and is screwed into Part 4. Part 6 is a Nylon finished Hex nut ¼" diameter. Part 7 is a Nylon Machine Screw 2" Length, slotted, ¼" diameter. Two Part 7 screws are threaded through Part 1 cover, one each on the left and right sides. Two Part 6 nuts are screwed onto Part 7 screw, one each on the left and right side, all the way up the screw so that Part 7 screw is surrounded on one side by Part 1 cover and the other side by Part 6 nut. Two Part 6 nuts are threaded onto Part 7 screw, one each on left and right side so that there is ¼" of Part 7 screw between nut and end of screw. Part 2 back cover is placed on top of Part 7 screw. Part 3, 4 and 5 are facing inward and are between Part 1 front cover and Part 2 back cover. Two Part 6 nuts are threaded onto each Part 7 screw, one each on left and right side so that Part 2 back cover sits between two sets of Part 6 nuts.

FIG. 3 is a perspective view from the front showing a left-side view of a night light constructed in accordance with the invention, showing the night light from the left side. Note that the image printed on the night light cover is an example of only one of the designs. The direct-print printing process allows the customer to choose any design of their choice with no limitations. Part 1 is the front cover of the night light and is made of 1/16" thick Translucent white acrylic with a decorative image printed directly onto the cover. Dimensions are 4" square (length and height). There is a ¼" diameter hole on both the right and left sides of Part 1, 2" up from the bottom and ¼" in from the left and right side of the cover. Part 2 is the back cover of the night light and is made of 1/16" thick Translucent white acrylic. Dimensions are 4" square (length and height). There is a ¼" diameter hole on both the right and left sides of Part 2, 2" up from the bottom and ¼" in from the left and right side of the cover. Part 3 is the Night Light clip-on shade mounting bracket and is attached with industrial strength adhesive to Part 2 back cover on the inside of Part 2 at the bottom centered between the right and left side. Part 4 is a standard night light fixture UL Listed and is clipped into Part 3. Part 5 is an LED night light bulb, ceramic style C7 bulb, E12 socket and is screwed into Part 4. Part 6 is a Nylon finished Hex nut ¼" diameter. Part 7 is a Nylon Machine Screw 2" Length, slotted, ¼" diameter. Two Part 7 screws are threaded through Part 1 cover, one each on the left and right sides. Two Part 6 nuts are screwed onto Part 7 screw, one each on the left and right side, all the way up the screw so that Part 7 screw is surrounded on one side by Part 1 cover and the other side by Part 6 nut. Two Part 6 nuts are threaded onto Part 7 screw, one each on left and right side so that there is ¼" of Part 7 screw between nut and end of screw. Part 2 back cover is placed on top of Part 7 screw with Part 6. Part 3, 4 and 5 are facing inward and are between Part 1 front cover and Part 2 back cover. Two Part 6 nuts are threaded onto each Part 7 screw, one each on left and right side so that Part 2 back cover sits between two sets of Part 6 nuts.

Operation

In operation one uses the night light in a similar manner to other decorative night lights by plugging into a wall outlet and turning on the switch. Frameless Decorative LED Night Light includes night light fixture and LED bulb. If the night light fixture and/or bulb ceases to work, the night light design allows for easy removal and replacement of bulb and/or night light fixture due to frameless design and addition of plastic bracket adhered to the bottom of the back cover that allows the night light fixture to pop in and out of the bracket. This night light provides more light than traditional night lights due to the frameless design that allows light to emit not only through the front decorative color but also from all four sides (top, bottom, left, right).

Conclusion

The Frameless Decorative LED Night Light has many advantages over prior night lights. These advantages include:

1: Ease of access to night light fixture and bulb. The addition of a plastic bracket at the bottom of the back cover allows for the night light fixture to be removed and replaced with ease as opposed to many nightlights that have the night light fixture adhered permanently to the night light base.

2: The frameless night light omits the left, right, top and bottom section that is used in many night lights to enclose the night light. This saves on material costs and manufacturing costs while providing easy access to the night light fixture and bulb.

3: Frameless design that provides more light than traditional night because light emanates not only through the front decorative cover but also from all four sides (top, bottom, left, right)

4: The direct-print printing process allows customer to choose any image without limitation, allowing for an infinite number of designs.

5: The direct-print printing method is an improvement on other night lights whose decorative image is adhered to the night light cover either via a sticker that will peel off over time or a design that allows a decorative image to be inserted into the front cover, which will bend and fade over time.

I claim:

1. A frameless night light comprising a front cover, a back cover, a bracket, a night light, a fixture, a light bulb and screws and nuts, wherein the front and back cover are permanently held together by the screws and nuts, wherein the bracket is permanently affixed to the back cover with adhesive, wherein light fixture snaps into the bracket and can be accessed without taking the frameless night light apart and without damaging the frameless night light.

2. The frameless night light according to claim 1, wherein the night light fixture is held snugly in place in the bracket but not permanently affixed and can be removed and replaced without taking the frameless night light apart.

3. The frameless night light according to claim 1, wherein the night light fixture is a separable, independent part that can be removed and replaced without taking apart the frameless night light.

4. The frameless night light according to claim 1, wherein the only connection between the front and back cover is two screws inserted into left and right side of front and back covers and nuts holding screws in place whereby the frameless night light will not come apart if pulled on.

5. The frameless night light according to claim 1, wherein a decorative image is printed onto the front cover wherein the decorative image is selected from different designs.

6. The frameless night light according to claim 1, wherein the shape of the frameless night light is square which causes no waste of materials in the fabrication of the frameless night light whereby dimensions of the frameless night light allow use of a full sheet of material in the fabrication of the frameless night light.

7. The frameless night light according to claim 1, wherein the front cover includes an image printed on the front of the frameless night light and resulting in the ability to create different designs.

* * * * *